US009012821B2

(12) United States Patent
Qiu et al.

(10) Patent No.: US 9,012,821 B2
(45) Date of Patent: Apr. 21, 2015

(54) DIGITAL CONTROL TYPE POWER CONVERTER FOR COOKING UTENSILS

(75) Inventors: Shouqing Qiu, Guangdong (CN); Samson Xu, Guangdong (CN)

(73) Assignee: Shenzhen CHK Co., Ltd., Shenzhen, Guangdong (CN)

( * ) Notice: Subject to any disclaimer, the term of this patent is extended or adjusted under 35 U.S.C. 154(b) by 570 days.

(21) Appl. No.: 13/381,090

(22) PCT Filed: May 19, 2010

(86) PCT No.: PCT/CN2010/072917

§ 371 (c)(1), (2), (4) Date: Dec. 27, 2011

(87) PCT Pub. No.: WO2011/003301

PCT Pub. Date: Jan. 13, 2011

(65) Prior Publication Data

US 2012/0103977 A1 May 3, 2012

(30) Foreign Application Priority Data

Jul. 7, 2009 (CN) ..... 2009 1 0108604

(51) Int. Cl.
*H05B 6/62* (2006.01)
*H05B 6/06* (2006.01)

(52) U.S. Cl.
CPC ..... *H05B 6/062* (2013.01)

(58) Field of Classification Search
USPC ..... 219/620–627; 99/34, 422–425; 374/141–156; 126/373.1–390
See application file for complete search history.

(56) References Cited

U.S. PATENT DOCUMENTS 7,271,372 B2 * 9/2007 Liu et al. ..... 219/620

* cited by examiner

*Primary Examiner* — Henry Yuen
*Assistant Examiner* — Thomas Ward
(74) *Attorney, Agent, or Firm* — Jackson IPG PLLC; Demian K. Jackson

(57) ABSTRACT

A digital control type power converter for cooking utensils includes a rectifier; a power inverting circuit composed of an IGBT and an LC shunt-resonant circuit; and a SoC chip which internally integrates a MPU, a Programmable Pulse Generator (PPG), an ADC, a COM, wherein the PPG, the ADC and the COM are connected to the MPU. One output of the MPU is connected to the PPG through a first AND gate, and a pulse signal outputted by the PPG is transmitted to the IGBT through a second AND gate. The MPU calculates the present power value according to measured current and voltage signals, and compares the present power value with the required power of the host computer to change the set pulse width value of the PPG. When a magnetic energy conversion detecting circuit outputs an enabling signal, the PPG outputs the pulse signal with the setting pulse width to drive the IGBT and realize the regulation of power. Since this converter can receive man-machine operating instructions and dynamically change its output power, the inductive structure in the resonant circuit can be appropriately changed to be applied to high-frequency heating equipment, such as a microwave oven, an electromagnetic oven, and the alike.

8 Claims, 4 Drawing Sheets

DIGITAL CONTROL TYPE POWER CONVERTER FOR COOKING UTENSILS

TECHNICAL FIELD OF THE INVENTION

The invention relates to a digital control type power converter for cooking utensils, based on the System-on-Chip (SoC) chip, the power converter is applicable to high-frequency heating equipment such as microwave ovens and electromagnetic ovens.

BACKGROUND OF THE INVENTION

Most existing power converters are simulated from pure hardware circuit structures which are usually called 'switch power circuits', the purpose is to output voltage stably, the working frequency and the output voltage are stable, but the output power thereof changes along with loads. For equipment such as electromagnetic ovens and microwave ovens, it is necessary to select different powers to heat according to the kind of foods to be heated and the quantity of foods to be heated, obviously, the existing power converters are not applicable to electromagnetic ovens and microwave ovens.

At present, based on SoC chip, the frequency and the specific structure of the inductive load in the resonant circuit are changed to change the output power; so far, a digital control type power converter applicable to high-frequency heating equipment such as microwave ovens and electromagnetic ovens has not been disclosed in any relevant documents.

SUMMARY OF THE INVENTION

In order to avoid defects existing in the prior art, the invention provides a digital control type power converter for cooking utensils, which is based on the control of an SoC chip and equipped with various optimally designed protection circuits, to improve the operating reliability, reduce production cost, change the specific structure of the inductive load in the resonant circuit in the power converter, so that the digital control type power converter can be applicable to high-frequency heating equipment such as microwave ovens and electromagnetic ovens.

The digital control type power converter for cooking utensils comprises: a rectifier, a filter, a power inverting circuit and a control unit used for regulating the output power of the power inverting circuit; wherein, the power inverting circuit comprises an IGBT and an LC resonant circuit consisting of an inductive load and a capacitor connected in parallel with the inductive load, wherein the LC resonant circuit is connected between the positive end of the rectifier and the source of the IGBT, and the drain of the IGBT is grounded;

the control unit is a System-on-Chip (SoC) chip which is internally integrated with a Micro Processing Unit (MPU), a Programmable Pulse Generator (PPG), an Analog-to-Digital Converter (ADC), a communication interface (COM), an amplifier, first to fourth comparators, a first trigger, a second trigger, a counter and two AND gates; wherein the ADC and the communication interface are respectively connected with the corresponding input ends of the MPU; the pulse width data output end of the MPU is connected with the preset input end of the PPG, one output of the MPU is connected with the PPG through the first AND gate, and the pulse signal output by the PPG is transmitted to the IGBT through the second AND gate;

the digital control type power converter for cooking utensils further comprises:

a magnetic energy conversion detecting circuit, which is used for providing an enabling output signal to the PPG, and which comprises the first trigger, the first comparator and two off-chip sampling resistors connected with the two input ends of the first comparator and the two ends of the LC resonant circuit, wherein the output of the first comparator is connected with one input end of the MPU and the other input end of the first AND gate through the first trigger;

an inverse peak intensity detecting circuit, which comprises the second comparator, the counter and an off-chip sampling resistor connected with the source of the IGBT, wherein the counter is connected between the output of the second comparator and the other input end of the MPU, one input of the second comparator compares the reverse potential input by the sampling resistor with the preset reference potential, when the reverse potential is higher than the preset reference potential, a pulse signal is output to make the counter counts, the MPU reduces the pulse width output by the PPG according to the count value of the counter within unit time; and, a current detecting circuit, which comprises the amplifier and a current sampling circuit connected with the main loop, wherein the amplifier is connected between the current sampling circuit and one input end of the ADC; the MPU calculates the current power value according to the current signal and the voltage signal measured by the current detecting circuit and the voltage detecting circuit, compares the current power value with the required output power of the host computer from the communication interface to change the set pulse width value of the PPG, when the magnetic energy conversion detecting circuit outputs the enabling output signal, outputs the pulse signal with the set pulse width to drive the IGBT to work and realize the regulation of the power inverting circuit.

The invention may comprise a current and voltage surge protection circuit which captures the surge voltage or current signal to shut the IGBT off; the protection circuit comprises the third comparator, the fourth comparator, the second trigger, the input of which is connected with the outputs of the third comparator and the fourth comparator, an off-chip surge current sampling circuit and an off-chip surge voltage sampling circuit, and the output of the second trigger is connected with the other input end of the second AND gate; and the surge current sampling circuit and the surge voltage sampling circuit are respectively connected with the input end of the third comparator and the input end of the fourth comparator.

The inductive load in the power inverting circuit is the electromagnetic coil panel of an electromagnetic oven.

The inductive load in the power inverting circuit is the primary coil of a leakage transformer of a microwave oven.

A microwave oven comprises: a leakage transformer having a primary coil, a filament coil and a high voltage coil; a high voltage rectification and filtering circuit connected with the high voltage coil of the leakage transformer; and a magnetron connected with the high voltage rectification and filtering circuit, wherein the filament of the magnetron is connected with the filament coil; the microwave oven further comprises a digital control type power converter used for regulating the power of the microwave oven; wherein the digital control type power converter comprises:

a rectifier and a filter, which converter AC mains into DC power;

a power inverting circuit, comprising an IGBT and an LC shunt-resonant circuit consisting of the primary coil of the leakage transformer and a capacitor, wherein the LC shunt-resonant circuit is connected between the positive end of the rectifier and the source of the IGBT;

a control unit applied with an SoC chip, wherein the SoC chip is internally integrated with an MPU, a PPG, an ADC, a communication interface, an amplifier, first to fourth comparators, a first trigger, a second trigger, a counter and two AND gates; wherein the ADC and the communication interface are respectively connected with the corresponding input ends of the MPU; the pulse width data output end of the MPU is connected with the preset input end of the PPG, one output of the MPU is connected with the PPG through the first AND gate, and the pulse signal output by the PPG is transmitted to the IGBT through the second AND gate;

a magnetic energy conversion detecting circuit, which comprises the first trigger, the first comparator and two off-chip sampling resistors connected with the two input ends of the first comparator and the two ends of the LC resonant circuit, wherein the output of the first comparator is connected with one input end of the MPU and the other input end of the first AND gate through the first trigger;

an inverse peak intensity detecting circuit, which comprises the second comparator, the counter and an off-chip sampling resistor connected with the source of the IGBT, wherein the counter is connected between the output of the second comparator and the other input end of the MPU, one input of the second comparator compares the reverse potential input by the sampling resistor with the preset reference potential, when the reverse potential is higher than the preset reference potential, a pulse signal is output to make the counter counts, the MPU reduces the pulse width output by the PPG according to the count value of the counter within unit time; and, a current detecting circuit, which comprises the amplifier and a current sampling circuit connected with the main loop, wherein the MPU calculates the current power value according to the current signal and the voltage signal measured by the current detecting circuit and the voltage detecting circuit, compares the current power value with the required output power of the host computer from the communication interface to change the set pulse width value of the PPG, when the magnetic energy conversion detecting circuit outputs the enabling output signal, outputs the pulse signal with the set pulse width to drive the IGBT to work and realize the regulation of the power inverting circuit.

The invention relates to a digital control type power converter based on SoC chip, which can digitally communicate with the host computer; after receiving the instruction requiring for output power from the host computer, the MPU calculates the present power value according to the measured current and voltage signals, compares the present power value with the required output power in the instruction, and sets an appropriate output pulse width value; the PPG outputs pulse signal in corresponding frequency to drive the IGBT to work and realize the regulation of power.

As the power converter can receive man-machine operating instructions from the communication interface and dynamically change the output power of the transformer, the structure of the inductive load in the resonant circuit in the power converter can be appropriately changed, so that the power converter can be applied to high-frequency heating equipment such as microwave ovens and electromagnetic ovens.

For common power converters, when the load changes, the electromotive force of the LC resonant circuit will have large abrupt change, the peak of the reverse potential will be quite high, even result in breakdown of the switching tubes and damages of components, therefore common power converters are designed with peak absorption protection circuits. The power converter in the invention is not equipped with any peak absorption circuit, instead, it is equipped various protection circuits such as magnetic energy conversion detecting circuit and inverse peak intensity detecting circuit, the MPU executes comprehensive control according to various factors such as magnetic energy change and inverse peak intensity, so that the operating reliability is improved greatly.

DETAILED DESCRIPTION OF THE INVENTION

The invention will be further described below with reference to drawings.

The digital control type power converter as shown in FIG. 1 to FIG. 4 comprises: a rectifier bridge B, a filter capacitor CO, a power inverting circuit, a control unit for regulating the output power of the power inverting circuit, a magnetic energy conversion detecting circuit, an inverse peak intensity detecting circuit and a current detecting circuit and the like.

Wherein, the power inverting circuit comprises an IGBT and an L1C1 resonant circuit consisting of an inductive load L1 and a capacitor C1 connected in parallel with the inductive load, the L1C1 resonant circuit is connected between the positive output end of the rectifier bridge B and the source of the IGBT, and the drain of the IGBT is grounded;

the control unit is designed based on an SoC chip, the SoC chip is internally integrated with an MPU, a PPG, an ADC, a COM, an amplifier AP1, first to fourth comparators (CP1-CP4), a first trigger, a second trigger, a counter and two dual-input AND gates; wherein the ADC and the communication interface COM are respectively connected with the corresponding input ends of the MPU; the pulse width data output end of the MPU is connected with the preset input end of the PPG, one output of the MPU is connected with the enabling end of the PPG through the first dual-input AND gate&1, and the pulse signal output by the PPG is transmitted to the IGBT through the second dual-input AND gate;

the PPG consists of a pulse width memory and a pulse width output counter, the value of the pulse width memory is preset by the MPU, according to the value provided by the pulse width memory, the pulse width output counter outputs the pulse signal with the specified width according to the count value, the pulse width output counter is controlled through the enabling output signal from the magnetic energy conversion detecting circuit and the enabling output signal output by the MPU; when the pulse width output counter outputs the pulse signal, the signal from the surge protection circuit can stop the output of the pulse signal at an time through the second dual-input AND gate&2.

P is an auxiliary power supply which converts mains supply from the grid into low voltage DC power supply, to provide working power supply Vcc to the components such as SoC chip.

Figure 2:
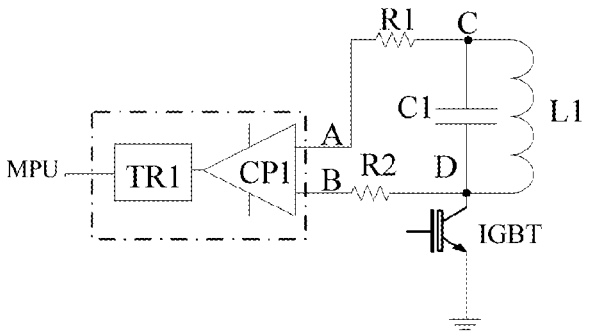
FIG. 2 shows the diagram of the magnetic energy conversion detecting circuit as shown in FIG. 1.

With reference to FIG. 2, the magnetic energy conversion detecting circuit comprises a first trigger TR1 inside the SoC chip, a first comparator CP1 and two off-chip sampling resistors R1 and R2 connected with the two input ends of the first comparator CP1 and the two ends of the LC resonant circuit, the output of the first comparator CP1 is connected with one input end of the MPU and the other input end of the first dual-input AND gate&1 through the first trigger TR1, to provide the enabling output signal to the PPG.

In the magnetic energy conversion detecting circuit, the off-chip sampling resistor R1 is connected with one input end (Point A) of the first comparator CP1 and the positive end (Point C) of the L1C1 resonant circuit connected with the power source, the other off-chip sampling resistor R2 is connected with the other input end (Point B) of the first comparator CP1 and the other end (Point D) of the L1C2 resonant circuit, the output of the first comparator CP1 is connected with one input end of the MPU and the other input end of the first dual-input AND gate & 1 through the first trigger TR1.

Parameters of R1 and R2 are regulated, under initial sate, the potential at Point A in CP1 is slightly higher than that at Point B, when the IGBT is turned on, current flows to Point D from Point C through L1, the potential at Point A is still higher than that at Point B, the CP1 and the TR1 are kept in the initial state. When the IGBT is turned off suddenly, the back electromotive force on L1 makes the potential at Point D higher than that at Point C so as to make the potential at Point B slightly higher than that at Point A, the output of the comparator CP1 is changed, the trigger TR1 is inverted to output the inversion signal. As the back electromotive force rises continuously, the state of the CP1 and the TR1 is kept unchanged. Then the back electromotive force on L1 charges C1, the back electromotive force drops gradually, when the back electromotive force on L1 is completely discharged and the potentials at two ends of L1 tend to be equal, the potential at Point A is higher than that at Point B again, the output of the comparator CP1 is changed, the trigger TR1 is inverted again to output the inversion signal, the inversion signal enables the PPG to output the pulse signal to drive the IGBT to work, the inversion signal guarantees least energy loss and highest conversion efficiency when the kinetic potential energy of the power converter is converted.

Figure 3:
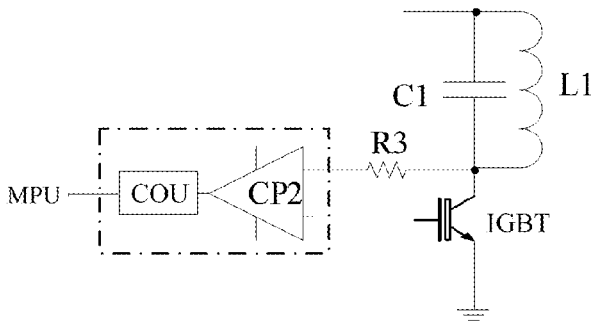
FIG. 3 shows the diagram of the inverse peak intensity detecting circuit as shown in FIG. 1.

With reference to FIG. 3, the inverse peak intensity detecting circuit comprises a second comparator CP2 inside the SoC chip, a counter (COU) and an off-chip sampling resistors R3 connected with the source of the IGBT, the COU is connected between the output of the second comparator CP2 and the other input end of the MPU, one input of the second comparator CP2 is compared with the preset reference potential through the reverse potential input by the sampling resistor R3, when the reverse potential is higher than the preset reference potential, the CP2 outputs the pulse signal, the counter counts, the MPU can judge the frequency of the occurrence of inverse peaks according to the value recorded by the counter within unit time so as to obtain the intensity value of the back electromotive force, the MPU reduces the pulse width output by the PPG according to the count value to make the flyback voltage peak drop. The detecting circuit executes advanced control for the flyback voltage peak, so that the stability of the flyback votage and the safety of the IGBT circuit are guaranteed.

Figure 1:
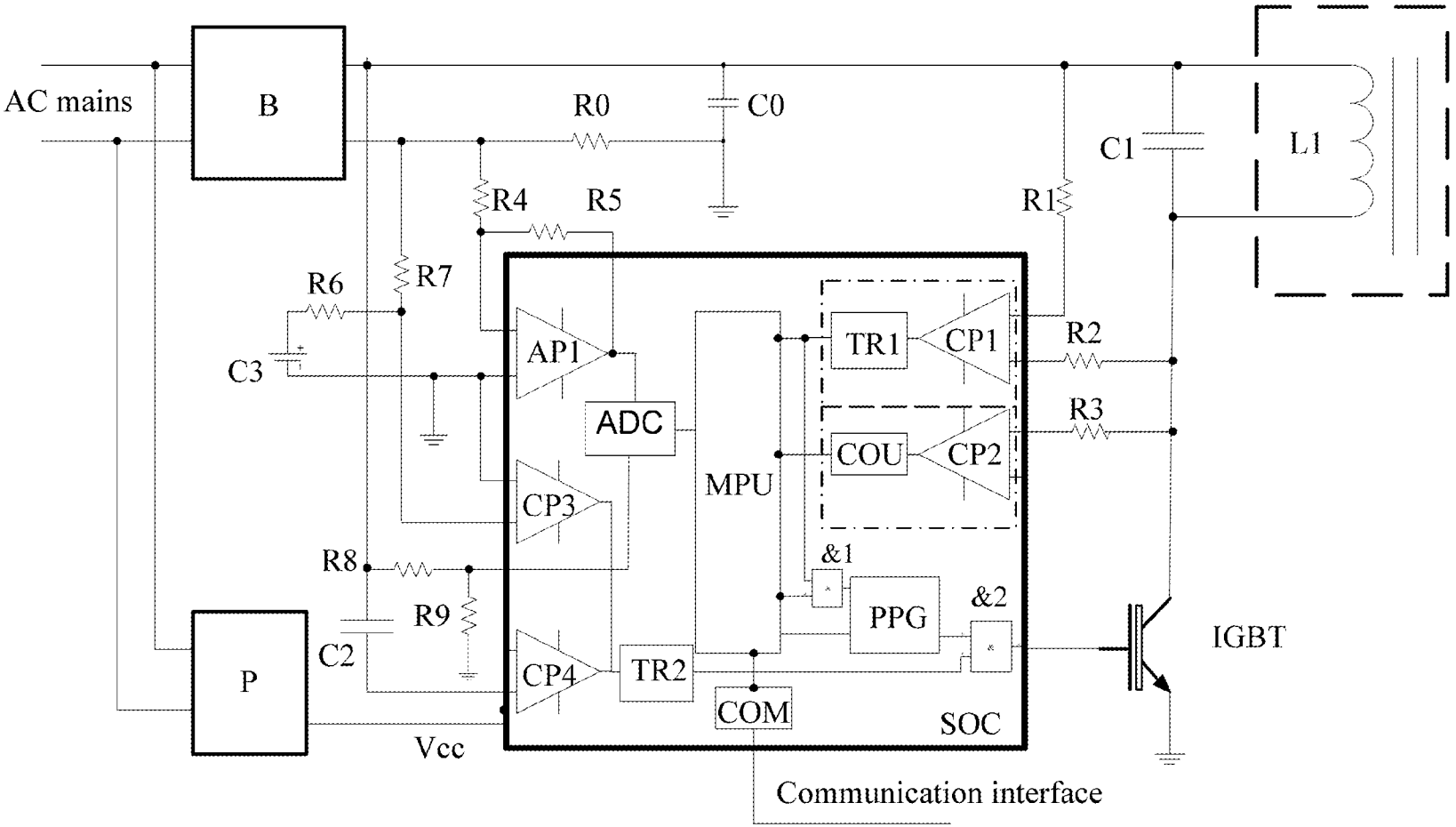
FIG. 1 shows the principle diagram of a digital control type power converter for cooking utensils.

In FIG. 1, the current detecting circuit comprises an amplifier AP1 inside the SoC chip and a current sampling circuit connected with the main loop, the amplifier AP1 is connected between the current sampling circuit and one input end of the ADC; the current sampling circuit comprises a constantan wire resistor R0 connected in series between a rectifier bridge B and the drain of the IGBT and a resistor R4 connected with the constantan wire resistor R0, the other end of the resistor R4 is connected with the inverting input end of the amplifier AP1, a feedback resistor R5 is connected between the inverting input end and the output end of the amplifier, and the non-inverting input end is grounded. When current flows through the constantan wire resistor R0, a potential far more negative than that of the ground is generated on R0, the negative voltage at the R0 end is input to the inverting amplifier AP1 through R4, the AP1 outputs the forward voltage which is then transmitted to the MPU through the ADC.

The voltage detecting circuit comprises two divider resistors R8 and R9 connected between the output end of the rectifier bridge B and the ground, the divider ends of the two divider resistors output the voltage signals to the other input end of the ADC, and then voltage signals are transmitted to the MPU through the ADC to process.

Figure 4:
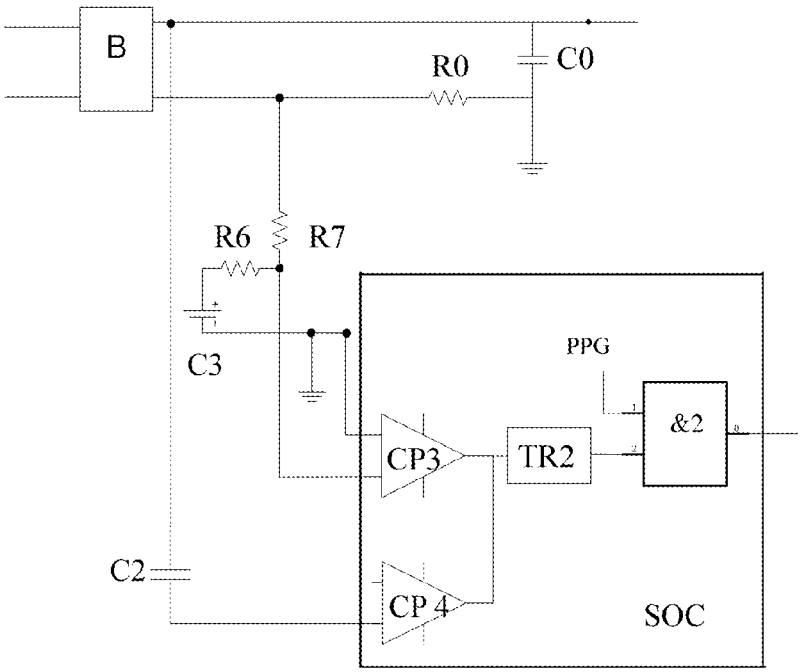
FIG. 4 shows the diagram of the current and voltage surge protection circuit as shown in FIG. 1.

A current and voltage surge protection circuit is further included, to capture the surge voltage or current signal to shut the driving signal of the IGBT off. With reference to FIG. 4 and FIG. 1, the protection circuit comprises a third comparator CP3, a fourth comparator CP4, a second trigger TR2, the input of which is connected with the outputs of the third comparator CP3 and the fourth comparator CP4, an off-chip surge current sampling circuit and an off-chip surge voltage sampling circuit in the SoC chip, and the output of the second trigger TR2 is connected with the other input end 2 of the second dual-input AND gate&2; the surge current sampling circuit and the surge voltage sampling circuit are respectively connected with the input end of the third comparator CP3 and the input end of the fourth comparator CP4. The surge current sampling circuit comprises: the constantan wire resistor RO connected in series between a rectifier bridge and the drain of the IGBT, and a serial branch consisting of resistors R7 and R6 connected with the constantan wire resistor R0 and a capacitor, the common ends of resistors R7 and R6 are connected with the input end of the third comparator CP3, and the reference end of the CP3 is grounded. The principle of the current surge protection is as follows: when current flows through R0, a negative voltage will be generated on R0. In the circuit, one end of the resistor R6 is connected with a positive potential, a positive bias is generated by the difference of voltage division by R6 and R7 on the input end of CP3 to be counteract the negative voltage generated by R0, when current surge occurs, a negative voltage that becomes high suddenly appears on R0, the negative voltage has a larger effect for CP3 than the effect of the positive bias generated by the difference of voltage division by R6 and R7, CP3 outputs a signal to make the trigger TR2 inversed, TR2 outputs the signal to the input end 2 of the second dual-input AND gate&2, to prohibit outputting the pulse signal from the PPG and shut the IGBT off, so as to achieve the purpose of current surge protection.

The surge voltage sampling circuit comprises a capacitor C2, the capacitor C2 is connected between the detection point at the output end of the rectifier bridge B and the input end of the fourth comparator CP4. When surge voltage occurs in the power, as voltage at the two ends of the capacitor C2 will not change suddenly, the suddenly changed surge voltage is reflected to the input end of the fourth CP4 in time, CP4 outputs a signal to make the trigger TR2 inversed, and TR2 outputs the signal to prohibit outputting the pulse signal from the PPG through the second dual-input AND gate&2, so as to achieve the purpose of voltage surge protection.

Control and operation programs and the like are stored in the built-in RAM (in this case, the RAM is arranged in the MPU) in the SoC chip as shown in FIG. 1. The MPU receives the control signal from the host computer through the communication interface COM, after receiving the instruction requiring output power, the MPU calculates the present power value according to the measured current and voltage signals, compares the present power value with the required output power in the instruction, and sets an appropriate pulse width value output by the PPG, when the magnetic energy conversion detecting circuit outputs the enabling output signal (when the magnetic energy is released to the minimum energy), the PPG is enabled to output the pulse signal with the set pulse width to drive the IGBT to work and realize the power regulation of the power inverting circuit. Such circulation makes the output power meet the requirements of the host computer, so that power conversion can be executed safely and stably.

Simultaneously, the MPU also needs to further change the set output width value according to the inverse peak intensity, that is, appropriately reduces the output width value of the PPG according to the detection value of the inverse peak intensity detecting circuit to make the flyback voltage peak drop.

In SoC, the MPU employs numerical values to limit the maximum width and the minimum width of the pulse width value output by the PPG, the cycle of outputting the pulse signal by the PPG is 18 microseconds to 50 microseconds, the frequency of outputting the pulse signal is 20K to 60 KHz.

The working frequency of the power converter is subject to the resonance parameters, generally, parameters of L1 and C1 are appropriately selected to just make the L1C1 resonance frequency slightly higher than 60 KHz.

As the power converter as shown in FIG. 1 can receive man-machine operating instructions through the communication interface to dynamically change the output power of the transformer, the structure of the resonant circuit consisting of the inductive load L1 and the capacitor C1, particularly the structure of the inductive load L1, is appropriately changed to be applied to the control of various high-frequency heating equipment. The inductive load L1 in the power inverting circuit as shown in FIG. 1 may be the electromagnetic coil panel of the electromagnetic oven, the primary coil of the leakage transformer of the microwave oven, the output coil of other high-frequency heating equipment, and the like.

When the power converter is applied in the microwave oven, the primary coil of the leakage transformer serves as the inductive load, a filament coil and a high voltage coil are arranged at the secondary of the leakage transformer, the high voltage coil supplies a DC high voltage to the magnetron through a high voltage rectification and filtering circuit, the filament coil stresses a preheating current to the filament of the magnetron, the microwave tube generates microwave to excite molecules of foods to be heated to move to generate heat energy to heat and boil foods.

Figure 5:
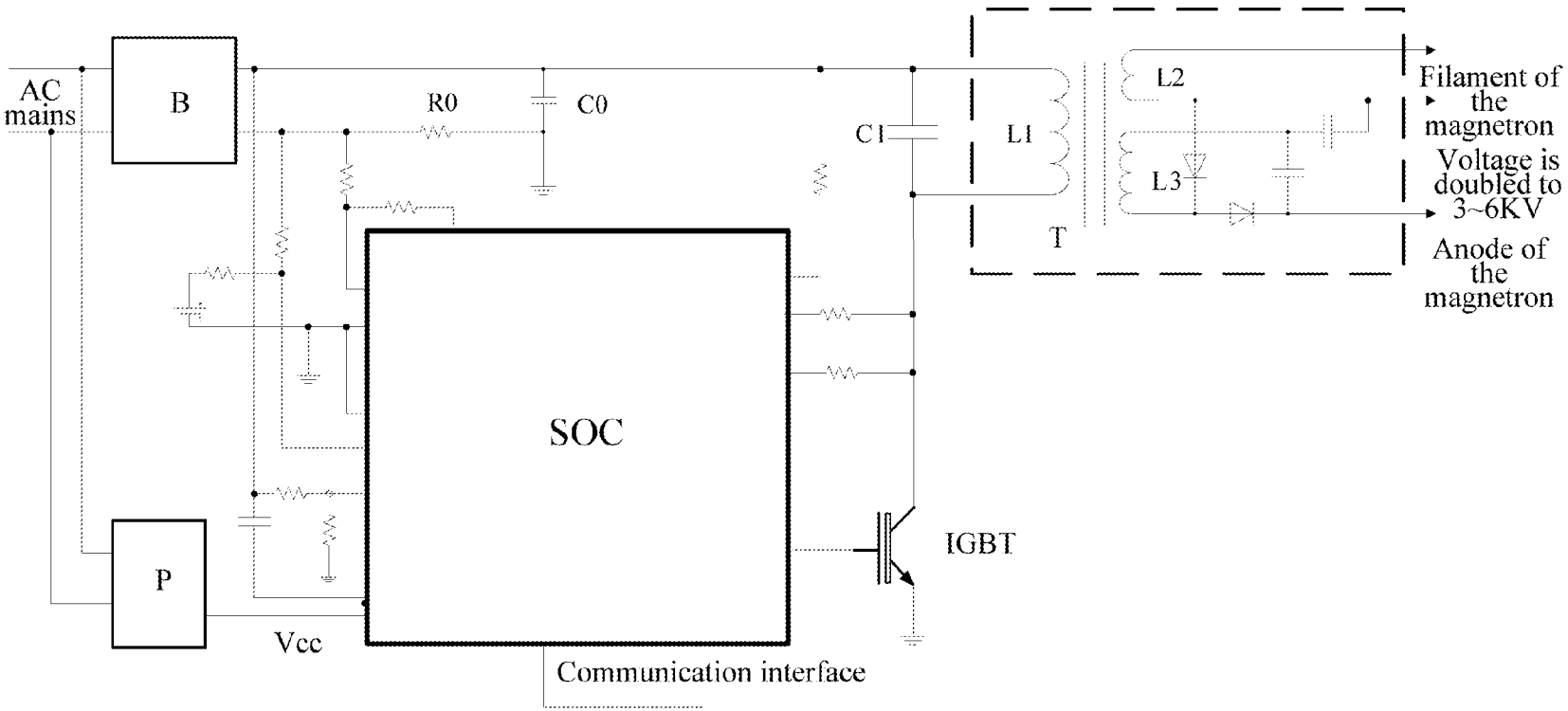
FIG. 5 shows the circuit diagram of the microwave oven applying the power converter as shown in FIG. 1.

FIG. 5 shows the circuit diagram of the microwave oven applying the power converter as shown in FIG. 1, the power of the microwave oven is continuously adjustable to meet the heating power requirements for different kinds of foods and different amount of foods. The microwave oven comprises: a leakage transformer T having a primary coil L1, filament coil L2 and a high voltage coil L3; a universal voltage doubling rectification and filtering circuit connected with the high voltage coil L3 of the leakage transformer T; a magnetron (not shown in FIG. 5) connected with the voltage doubling rectification and filtering circuit, wherein the filament of the magnetron is connected with the filament coil L2; and the power converter as shown in FIG. 1. In the power converter, the power inverting circuit comprises an IGBT and an L1C1 shunt-resonant circuit consisting of the primary coil L1 of the leakage transformer T and the capacitor C1, the L1C1 shunt-resonant circuit is connected between the positive end of the rectifier bridge B and the source of the IGBT, and the drain of the IGBT is grounded; other parts of the power converter, for example the control unit applying the SoC chip, the magnetic energy conversion detecting circuit, the inverse peak intensity detecting circuit, the current and voltage detecting circuit, the current and voltage surge protection circuit and the rectifier bridge B and so on are the same as the descriptions of FIG. 1 to FIG. 4 and will not be described herein.

Figure 6:
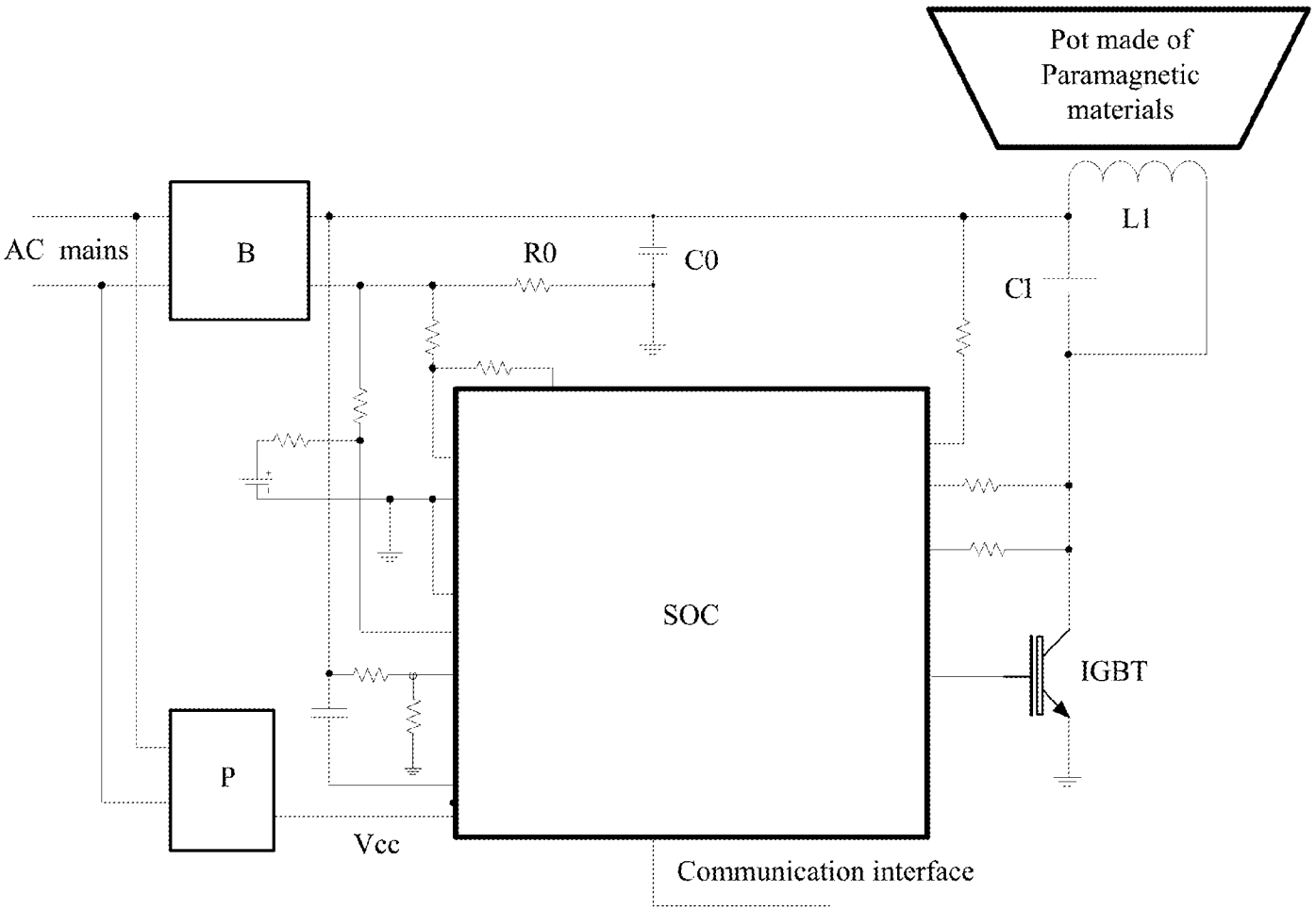
FIG. 6 shows the circuit diagram of the electromagnetic oven applying the power converter as shown in FIG. 1.

FIG. 6 shows the circuit diagram of the electromagnetic oven applying the power converter as shown in FIG. 1. Wherein the inductive load L1 in the power inverting circuit is the electromagnetic coil panel of the electromagnetic oven, and a pot made of paramagnetic materials for cooking is put on the electromagnetic coil panel.

The electromagnetic oven comprises the power converter part as shown in FIG. 1, as described above, the power converter comprises a rectifier bridge B, a filter capacitor C0, a power inverting circuit, a control unit applying the SoC chip, a magnetic energy conversion detecting circuit, an inverse peak intensity detecting circuit, a current and voltage detecting circuit, a current and voltage surge protection circuit and the like. Wherein, the power inverting circuit comprises an IGBT and the electromagnetic coil panel of a built-in electromagnetic coil L1, the electromagnetic coil L1 and the capacitor C1 form a shunt-resonant circuit, the shunt-resonant circuit is connected between the positive end of the rectifier bridge B and the source of the IGBT, and the drain of the IGBT is grounded. During flyback voltage, the electromagnetic coil L1 will transmit the maximum energy to the pot made of paramagnetic materials, to form electromagnetic eddy current to heat the cooking utensils.

What is claimed is:

1. A digital control type power converter for cooking utensils, comprising a rectifier, a filter, a power inverting circuit and a control unit, wherein:

the power inverting circuit comprises an IGBT and an LC resonant circuit consisting of an inductive load and a capacitor connected in parallel with the inductive load, the LC resonant circuit is connected between the positive end of the rectifier and the source of the IGBT, and the drain of the IGBT is grounded;

the control unit is a SoC chip which is internally integrated with a Micro Processing Unit (MPU), an Analog-to-Digital Converter (ADC), a Programmable Pulse Generator (PPG), a communication interface, an amplifier, first to fourth comparators, a first trigger, a second trigger, a counter and two AND gates; wherein the ADC and the communication interface are respectively connected with the corresponding input ends of the MPU; the pulse width data output end of the MPU is connected with the preset input end of the PPG, one output of the MPU is connected with the PPG through the first AND gate, and the pulse signal output by the PPG is transmitted to the IGBT through the second AND gate;

the digital control type power converter for cooking utensils further comprises:

a magnetic energy conversion detecting circuit, which is used for providing an enabling output signal to the PPG, and which comprises the first trigger, the first comparator and two off-chip sampling resistors connected with the two input ends of the first comparator and the two ends of the LC resonant circuit, wherein the output of the first comparator is connected with one input end of the MPU and the other input end of the first AND gate through the first trigger;

an inverse peak intensity detecting circuit, which comprises the second comparator, the counter and an off-chip sampling resistor connected with the source of the IGBT, wherein the counter is connected between the output of the second comparator and the other input end of the MPU, one input of the second comparator is compared with the preset reference potential through the reverse potential input by the sampling resistor, when the reverse potential is higher than the preset reference potential, the second comparator outputs the pulse signal to make the counter counts, the MPU reduces the pulse width output by the PPG according to the count value of the counter within unit time; and, a current detecting circuit, which comprises the amplifier and a current sampling circuit connected with the main loop, wherein the amplifier is connected between the current sampling circuit and one input end of the ADC; the MPU calculates the current power value according to the current signal and the voltage signal measured by the current detecting circuit and the voltage detecting circuit, compares the current power value with the required output power of the host computer from the communication interface to change the set pulse width value of the PPG, when the magnetic energy conversion detecting circuit outputs the enabling output signal, outputs the pulse signal with the set pulse width to drive the IGBT to work and realize the regulation of the power inverting circuit.

2. The power converter according to claim 1, wherein the inductive load in the power inverting circuit is the electromagnetic coil panel of an electromagnetic oven.

3. The power converter according to claim 1, wherein the inductive load in the power inverting circuit is the primary coil of a leakage transformer of a microwave oven.

4. The power converter according to claim 3, wherein a filament coil for supplying power to the filament of a magnetron and a high voltage coil are arranged at the secondary of the leakage transformer of the microwave oven, and the high voltage coil supplies a DC voltage to the magnetron through a high voltage rectification and filtering circuit.

5. The power converter according to claim 1, wherein the current sampling circuit comprises a constantan wire resistor R0 connected in series between the rectifier bridge and the drain of the IGBT and a resistor R4 connected with the constantan wire resistor R0, the output of the current sampling circuit is connected with the inverting input end of the amplifier, a feedback resistor R5 is connected between the inverting input end and the output end of the amplifier, and the non-inverting input end is grounded.

6. The power converter according to claim 1, further comprising a current and voltage surge protection circuit which captures the surge voltage or current signal to shut the IGBT off;

the protection circuit comprises the third comparator, the fourth comparator, the second trigger, the input of which is connected with the outputs of the third comparator and the fourth comparator, an off-chip surge current sampling circuit and an off-chip surge voltage sampling circuit, and the output of the second trigger is connected with the other input end of the second AND gate; and the surge current sampling circuit and the surge voltage sampling circuit are respectively connected with the input end of the third comparator and the input end of the fourth comparator.

7. The power converter according to claim 6, wherein the surge current sampling circuit comprises the constantan wire resistor RO connected in series between the rectifier bridge and the drain of the IGBT, and a serial branch consisting of resistors R7 and R6 connected with the constantan wire resistor RO and a capacitor C3, the common ends of resistors R7 and R6 are connected with the input end of the third comparator; the surge voltage sampling circuit comprises a capacitor C2 connected between the output end of the rectifier and the input end of the fourth comparator.

8. The power converter according to claim 1, wherein, in the magnetic energy conversion detecting circuit, one off-chip sampling resistor is connected with one input end of the first comparator and the end of the LC resonant circuit connected with the power source, and the other off-chip sampling resistor is connected with the other input end of the first comparator and the other end of the LC resonant circuit.

* * * * *